US010821572B2

(12) United States Patent
Jeong et al.

(10) Patent No.: US 10,821,572 B2
(45) Date of Patent: Nov. 3, 2020

(54) METHOD OF CONTROLLING A TEMPERATURE OF A CHEMICAL MECHANICAL POLISHING PROCESS, TEMPERATURE CONTROL, AND CMP APPARATUS INCLUDING THE TEMPERATURE CONTROL

(71) Applicant: SAMSUNG ELECTRONICS CO., LTD., Suwon-si, Gyeonggi-do (KR)

(72) Inventors: Suk-Hoon Jeong, Hwaseong-si (KR); Sang-Hak Lee, Hwaseong-si (KR); Geun-Kyu Choi, Hwaseong-si (KR); Chang-Sun Hwang, Hwaseong-si (KR); Tae-Young Kwon, Seoul (KR); Young-Sang Kim, Seoul (KR); Hyung-Kyu Jin, Hwaseong-si (KR); Jeong-Nam Han, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 309 days.

(21) Appl. No.: 15/926,244

(22) Filed: Mar. 20, 2018

(65) Prior Publication Data

US 2019/0091828 A1 Mar. 28, 2019

(30) Foreign Application Priority Data

Sep. 26, 2017 (KR) ..... 10-2017-0124243

(51) Int. Cl.

| | |
|---|---|
| ***B24B 37/00*** | (2012.01) |
| ***B24B 37/015*** | (2012.01) |
| ***B24B 55/02*** | (2006.01) |
| ***B24B 49/14*** | (2006.01) |
| ***B24B 37/26*** | (2012.01) |

(52) U.S. Cl.

CPC ..... *B24B 37/015* (2013.01); *B24B 37/26* (2013.01); *B24B 49/14* (2013.01); *B24B 55/02* (2013.01)

(58) Field of Classification Search

CPC ..... B24B 37/015; B24B 37/26; B24B 49/14
USPC ..... 451/7
See application file for complete search history.

(56) References Cited

U.S. PATENT DOCUMENTS 5,735,731 A * 4/1998 Lee ..... B24B 37/22 451/143
5,873,769 A * 2/1999 Chiou ..... B24B 37/015 257/E21.23

(Continued)

FOREIGN PATENT DOCUMENTS

| | | | |
|---|---|---|---|
| JP | 2013-59831 | A | 4/2013 |
| KR | 10-2016-0145305 | A | 12/2016 |
| KR | 10-2017-0073292 | A | 6/2017 |

*Primary Examiner* — George B Nguyen
(74) *Attorney, Agent, or Firm* — Lee IP Law, P.C.

(57) ABSTRACT

A method of controlling a chemical mechanical polishing (CMP) process, a temperature control, and a CMP apparatus, the method including measuring actual temperatures of at least two regions in a platen in real time during the CMP process in which a polishing pad attached to the platen polishes a substrate held by a polishing head using slurry and deionized water; receiving the measured actual temperatures of the regions; and individually controlling the actual temperatures of the regions in real time during the CMP process to provide the regions with a predetermined set CMP process temperature.

18 Claims, 6 Drawing Sheets

(56) References Cited

U.S. PATENT DOCUMENTS 5,893,754 A * 4/1999 Robinson ..... H01L 21/31053 216/38
5,957,750 A * 9/1999 Brunelli ..... B24B 49/14 257/E21.23
6,358,119 B1 * 3/2002 Shih ..... B24B 37/015 451/36
7,155,915 B2 * 1/2007 Shin ..... F25B 21/02 62/259.2
7,169,014 B2 * 1/2007 Taylor ..... B24B 37/26 451/285
7,201,634 B1 * 4/2007 Naujok ..... B24B 37/015 451/288
7,214,123 B2 * 5/2007 Han ..... B24B 37/32 451/285
7,238,084 B2 7/2007 Kim
7,378,280 B2 * 5/2008 Quake ..... F04B 43/043 436/63
8,257,142 B2 * 9/2012 Muldowney ..... B24B 37/24 451/41
2006/0094338 A1 * 5/2006 Kim ..... B24B 37/24 451/7
2007/0227901 A1 * 10/2007 Hu ..... B23H 5/08 205/640
2010/0035515 A1 * 2/2010 Marks ..... B24B 37/015 451/5
2010/0203806 A1 * 8/2010 Kitakura ..... B24B 37/015 451/7
2013/0090040 A1 * 4/2013 Duescher ..... B24B 37/107 451/28
2014/0015107 A1 * 1/2014 Chen ..... B24B 37/015 257/618
2017/0232572 A1 * 8/2017 Brown ..... B24B 37/015 451/5
2019/0143476 A1 * 5/2019 Wu ..... B24B 37/015
2020/0070301 A1 * 3/2020 Cui ..... B24B 37/015

* cited by examiner

METHOD OF CONTROLLING A TEMPERATURE OF A CHEMICAL MECHANICAL POLISHING PROCESS, TEMPERATURE CONTROL, AND CMP APPARATUS INCLUDING THE TEMPERATURE CONTROL

CROSS-REFERENCE TO RELATED APPLICATION

Korean Patent Application No. 10-2017-0124243, filed on Sep. 26, 2017, in the Korean Intellectual Property Office, and entitled: "Method of Controlling a Temperature of a Chemical Mechanical Polishing Process, Temperature Control Unit for Performing the Method, and CMP Apparatus Including the Temperature Control Unit," is incorporated by reference herein in its entirety.

BACKGROUND

1. Field

Embodiments relate to a method of controlling a temperature of a chemical mechanical polishing (CMP) process, a temperature control, and a CMP apparatus including the temperature control.

2. Description of the Related Art

Generally, a layer on a semiconductor substrate may be planarized using a CMP apparatus. The CMP apparatus may include a polishing head configured to hold the semiconductor substrate, a platen attached to a polishing pad, a nozzle configured to supply slurry and deionized water to the polishing pad, etc.

SUMMARY

The embodiments may be realized by providing a method of controlling a chemical mechanical polishing (CMP) process, the method including measuring actual temperatures of at least two regions in a platen in real time during the CMP process in which a polishing pad attached to the platen polishes a substrate held by a polishing head using slurry and deionized water; receiving the measured actual temperatures of the regions; and individually controlling the actual temperatures of the regions in real time during the CMP process to provide the regions with a predetermined set CMP process temperature.

The embodiments may be realized by providing a temperature control for a CMP process, the temperature controller including a plurality of first temperature sensors configured to measure actual temperatures of at least two regions in a platen in real time during the CMP process in which a polishing pad attached to the platen polishes a substrate held by a polishing head using slurry and deionized water; and a first temperature controller configured to receive the measured actual temperatures of the regions, and individually control the actual temperatures of the regions in real time during the CMP process to provide the regions with a predetermined set CMP process temperature.

The embodiments may be realized by providing a CMP apparatus including a polishing head configured to hold a substrate; a platen arranged under the polishing head; a polishing pad for polishing the substrate attached to the platen; a nozzle configured to supply slurry and deionized water to a space between the substrate and the polishing pad; a plurality of first temperature sensors configured to measure actual temperatures of at least two regions in the platen in real time during the CMP process; and a first temperature controller configured to receive the measured actual temperatures of the regions, and to individually control the actual temperatures of the regions in real time during the CMP process to provide the regions with a predetermined set CMP process temperature.

BRIEF DESCRIPTION OF THE DRAWINGS

Features will be apparent to those of ordinary skill in the art by describing in detail exemplary embodiments with reference to the attached drawings in which.

DETAILED DESCRIPTION

Figure 1:
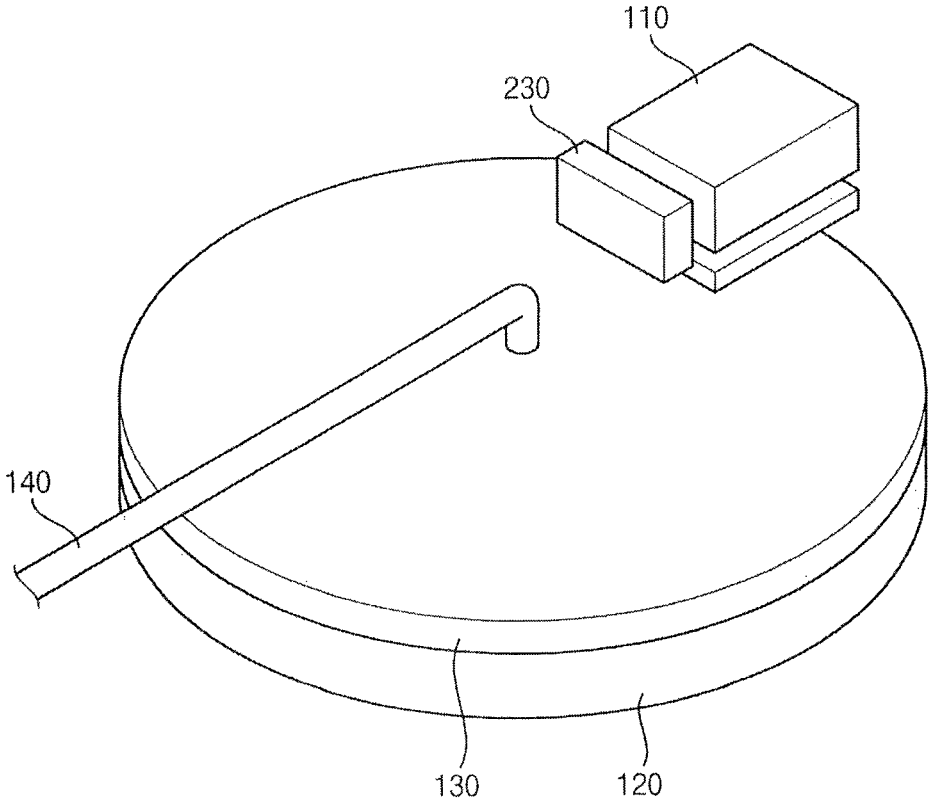
FIG. 1 illustrates a perspective view illustrating a CMP apparatus in accordance with example embodiments.
Figure 2:
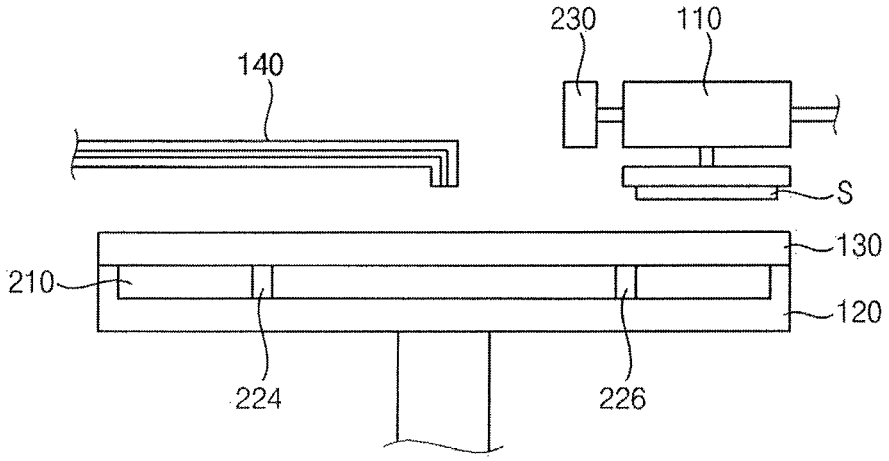
FIG. 2 illustrates a cross-sectional view of the CMP apparatus in FIG. 1.
Figure 3:
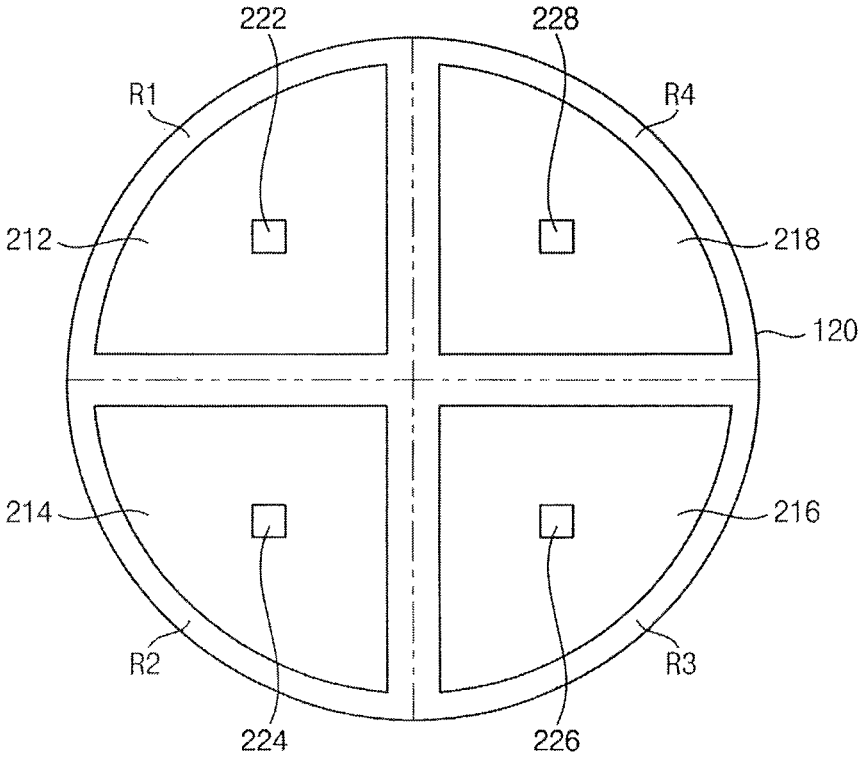
FIG. 3 illustrates a plan view of a first temperature controller in a platen of the CMP apparatus in FIG. 1.
Figure 4:
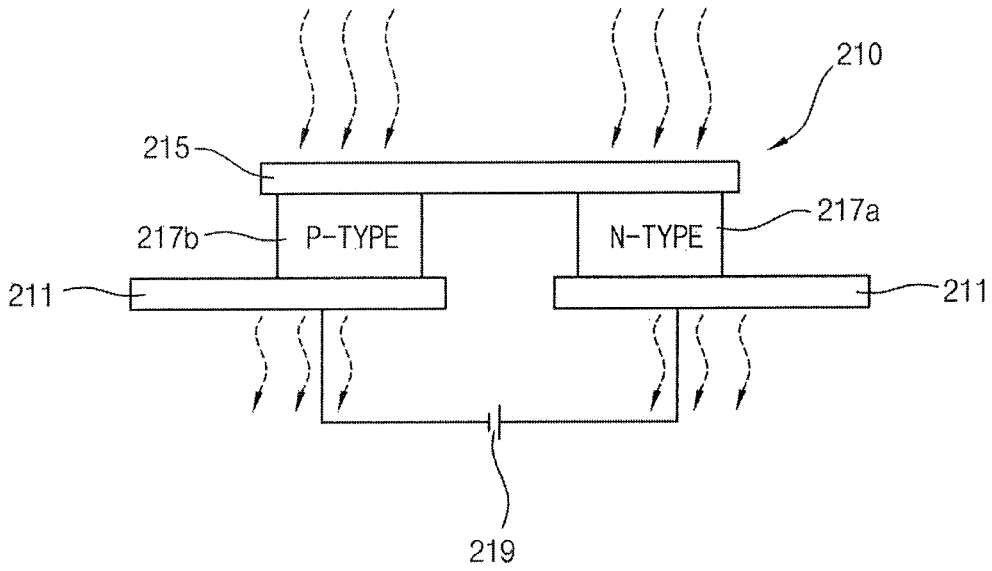
FIG. 4 illustrates a cross-sectional view of an example of a temperature control as the first temperature controller in FIG. 3.
Figure 5:
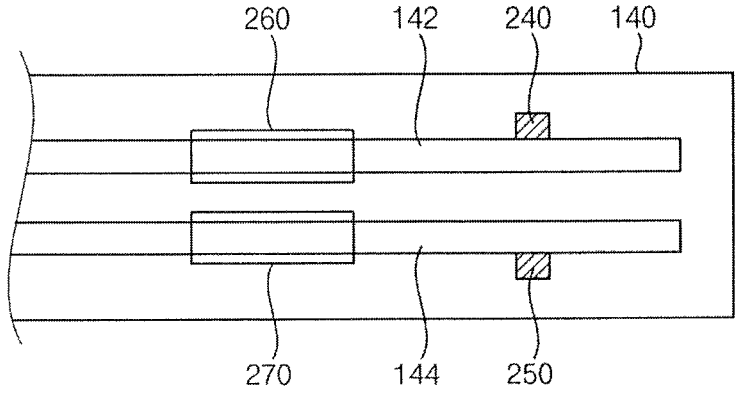
FIG. 5 illustrates a cross-sectional view of a nozzle of the CMP apparatus in FIG. 2.

FIG. 1 illustrates a perspective view of a CMP apparatus in accordance with example embodiments, FIG. 2 illustrates a cross-sectional view of the CMP apparatus in FIG. 1, FIG. 3 illustrates a plan view of a first temperature controller in a platen of the CMP apparatus in FIG. 1, FIG. 4 illustrates a cross-sectional view of an example of a temperature control as the first temperature controller in FIG. 3, and FIG. 5 illustrates a cross-sectional view of a nozzle of the CMP apparatus in FIG. 2.

Referring to FIGS. 1 and 2, a CMP apparatus of this example embodiment may include a polishing head 110, a platen 120, a polishing pad 130, a nozzle 140, and a temperature control.

The polishing head 110 may be arranged over or facing the platen 120. The polishing head 110 may be configured to hold a substrate S. The polishing head 110 may include a rotational shaft configured to rotate the substrate S. In an implementation, the substrate S may include a semiconductor substrate, a glass substrate, etc.

The platen 120 may be arranged under or facing the polishing head 110. The platen 120 may be rotated by a rotational shaft. A rotating direction of the plate 120 may be opposite to a rotating direction of the substrate S.

The polishing pad 130 may be arranged on or at an upper surface of the platen 120. The polishing pad 130 may be rotated by or along with the platen 120. The rotated polishing pad 130 may make frictional contact with the substrate S rotated in the direction opposite to the rotating direction of the polishing pad 130 to polish a layer on the substrate S.

The nozzle 140 may be arranged over the platen 120. The nozzle 140 may be configured to supply slurry and deionized water to an upper surface of the polishing pad 130. The slurry and the deionized water may be supplied to a space between the polishing pad 130 and the substrate S. For example, as shown in FIG. 5, a deionized water line 142 and a slurry line 144 may be arranged in the nozzle 140.

The temperature control may be configured to control an actual temperature of the platen 120 in real time during a CMP process. In an implementation, the temperature control may be configured to individually or independently control actual temperatures of at least two different regions of the platen 120 during the CMP process.

In an implementation, the temperature control may include, e.g., at least two first temperature sensors 222, 224, 226, and 228, a first temperature controller 210, a second temperature sensor 230, a third temperature sensor 240, a fourth temperature sensor 250, a second temperature controller 260, and a third temperature controller 270.

Referring to FIG. 3, the platen 120 may be divided into at least two regions. In an implementation, the platen 120 may be divided into a first region R1, a second region R2, a third region R3, and a fourth region R4. The first region R1, the second region R2, the third region R3, and the fourth region R4 may be defined by two diameter lines, which may pass through a center point of the platen 120, substantially perpendicular to each other. Thus, the first region R1, the second region R2, the third region R3, and the fourth region R4 may have ¼ of a circular arc shape. In an implementation, numbers of the regions may be two, three or at least five. In an implementation, the regions may have different shapes. In an implementation, each of the regions of the platen 120 may be divided into sub-regions.

The first temperature sensors 222, 224, 226, and 228 may be arranged in the first region R1, the second region R2, the third region R3, and the fourth region R4, respectively. For example, one first temperature sensor 222 may be arranged in the first region R1 to measure an actual temperature of the first region R1 of the platen 120 in real time during the CMP process. Another first temperature sensor 224 may be arranged in the second region R2 to measure an actual temperature of the second region R2 of the platen 120 in real time during the CMP process. Another first temperature sensor 226 may be arranged in the third region R3 to measure an actual temperature of the third region R3 of the platen 120 in real time during the CMP process. Another first temperature sensor 228 may be arranged in the fourth region R4 to measure an actual temperature of the fourth region R4 of the platen 120 in real time during the CMP process.

The first temperature controller 210 may receive the actual temperatures of the regions R1, R2, R,3 and R4 of the platen 120 measured by the first temperature sensors 222, 224, 226, and 228. The first temperature controller 210 may be configured to individually control the actual temperatures of the regions R1, R2, R3, and R4 of the platen 120 during the CMP process. For example, the first temperature controller 210 may control the actual temperatures of the regions R1, R2, R3, and R4 of the platen 120 in real time during the CMP process. Further, the first temperature controller 210 may provide the regions R1, R2, R3, and R4 of the platen 120 with a predetermined CMP process temperature before the CMP process.

The first temperature controller 210 may be arranged in the first region R1, the second region R2, the third region R3, and the fourth region R4 of the platen 120, respectively. In an implementation, the first temperature controller 210 may include, e.g., a first temperature control 212 arranged in the first region R1, a second temperature control 214 arranged in the second region R2, a third temperature control 216 arranged in the third region R3, and a fourth temperature control 218 arranged in the fourth region R4. The first to fourth temperature controls 212, 214, 216, and 218 may selectively and/or independently receive power. For example, the first to fourth temperature controls 212, 214, 216, and 218 may be selectively driven in accordance with the temperatures measured in the first to fourth regions R1, R2, R3, and R4. In an implementation, four power supplies may be individually connected with the first to fourth temperature controls 212, 214, 216, and 218. In an implementation, one power supply may be connected with the first to fourth temperature controls 212, 214, 216 and 218 via a switch for selectively controlling the supplies of the power.

The first temperature control 212 may receive the actual temperature of the first region R1 measured by the first temperature sensor 222. If the measured actual temperature of the first region R1 were to be different from the set CMP process temperature, the first temperature control 212 may heat or cool the first region R1 to provide the first region R1 with a temperature corresponding to the CMP process temperature. In an implementation, the first temperature control 212 may provide the first region R1 with the CMP process temperature before the CMP process.

The second temperature control 214 may receive the actual temperature of the second region R2 measured by the first temperature sensor 224. If the measured actual temperature of the second region R1 were to be different from the set CMP process temperature, the second temperature control 214 may heat or cool the second region R2 to provide the second region R2 with a temperature corresponding to the CMP process temperature. In an implementation, the second temperature control 214 may provide the second region R2 with the CMP process temperature before the CMP process.

The third temperature control 216 may receive the actual temperature of the third region R3 measured by the first temperature sensor 226. If the measured actual temperature of the third region R3 were to be different from the set CMP process temperature, the third temperature control 216 may heat or cool the third region R3 to provide the third region R3 with a temperature corresponding to the CMP process temperature. In an implementation, the third temperature control 216 may provide the third region R3 with the CMP process temperature before the CMP process.

The fourth temperature control 218 may receive the actual temperature of the fourth region R4 measured by the first temperature sensor 228. If the measured actual temperature of the fourth region R4 were to be different from the set CMP process temperature, the fourth temperature control 218 may heat or cool the fourth region R4 to provide the fourth region R4 with a temperature corresponding to the CMP process temperature. In an implementation, the fourth temperature control 218 may provide the fourth region R4 with the CMP process temperature before the CMP process.

The first temperature controller 210 may heat or cool the platen 120 in accordance with the actual temperatures of the regions of the platen 120 and an actual temperature of the polishing pad 130. In an implementation, the first temperature controller 210 having the above-mentioned functions may include a Peltier element.

Referring to FIG. 4, the Peltier element may include first and second heat-emitting plates 211, a heat-absorbing plate 215 opposite to the first and second heat-emitting plates 211, and N type and P type semiconductor devices 217*a* and 217*b* interposed between the heat-absorbing plate 215 and the first and second heat-emitting plates 211. A power supply 219, e.g., a battery, may be electrically connected to the first and second heat-emitting plates 211.

A current may be provided to the first heat-emitting plate 211 from the power supply 219. The current may flow to the second heat-emitting plate 211 through the N type semiconductor device 217*a*, the heat-absorbing plate 215 and the P type semiconductor device 217*b*. Thus, the first and second heat-emitting plates 211 may emit heat. The heat-absorbing plate 215 may absorb a heat. This is due to the Peltier effect.

The Peltier effect may be explained as a principle that an ideal gas is cooled down by a constant entropy expansion. When an electron moves from a semiconductor having a high electron concentration to a semiconductor having a low electron concentration, an electron gas may expand and then works with respect to a potential barrier between two plates having a substantially same chemical potential, thereby electrically cooling down an object. The object may be cooled down at a temperature of about 195° F. using the Peltier effect.

In an implementation, the first temperature controller 210 may include other suitable apparatuses for heating and cooling an object.

Referring to FIG. 2, the second temperature sensor 230 may be configured to measure a surface temperature of the polishing pad 130 in real time during the CMP process. The second temperature sensor 230 may be attached to the polishing head 110. The surface temperature of the polishing pad 130 measured by the second temperature sensor 230 may be transmitted to the first temperature controller 210.

The second temperature sensor 230 attached to the polishing head 110 may measure the surface temperature of the polishing pad 130 as it performs the CMP process. For example, as a portion of the polishing pad 130 corresponding to the first region R1 of the platen 120 polishes the substrate S, the second temperature sensor 230 may measure a surface temperature of the portion of the polishing pad 130 (e.g., the portion of the polishing pad 130 overlying the first region R1 of the platen 120). The surface temperature of the portion of the polishing pad 130 may be transmitted to the first temperature control 212 of the first temperature controller 210. The first temperature control 212 may heat or cool the first region R1 of the platen 120 in accordance with the surface temperature of the portion of the polishing pad 130 to provide the first region R1 with the CMP process temperature in real time.

Therefore, the first temperature controller 210 may be selectively operated in accordance with the temperatures by the regions R1, R2, R3, and R4 of the platen 120 and the surface temperature of the polishing pad 130.

Referring to FIG. 5, the third temperature sensor 240 may be configured to measure a temperature of the deionized water in real time during the CMP process. The third temperature sensor 240 may be attached to the deionized water line 142. The second temperature controller 260 may receive the temperature of the deionized water measured by the third temperature sensor 240. The second temperature controller 260 may heat or cool the deionized water in accordance with the received temperature of the deionized water to provide the deionized water with the CMP process temperature. In an implementation, the second temperature controller 260 may include the Peltier element in FIG. 4.

The fourth temperature sensor 250 may be configured to measure a temperature of the slurry in real time during the CMP process. The fourth temperature sensor 250 may be attached to the slurry line 144. The third temperature controller 270 may receive the temperature of the slurry measured by the fourth temperature sensor 250. The third temperature controller 270 may heat or cool the slurry in accordance with the received temperature of the slurry to provide the slurry with the CMP process temperature. In an implementation, the third temperature controller 270 may include the Peltier element in FIG. 4.

Figure 6:
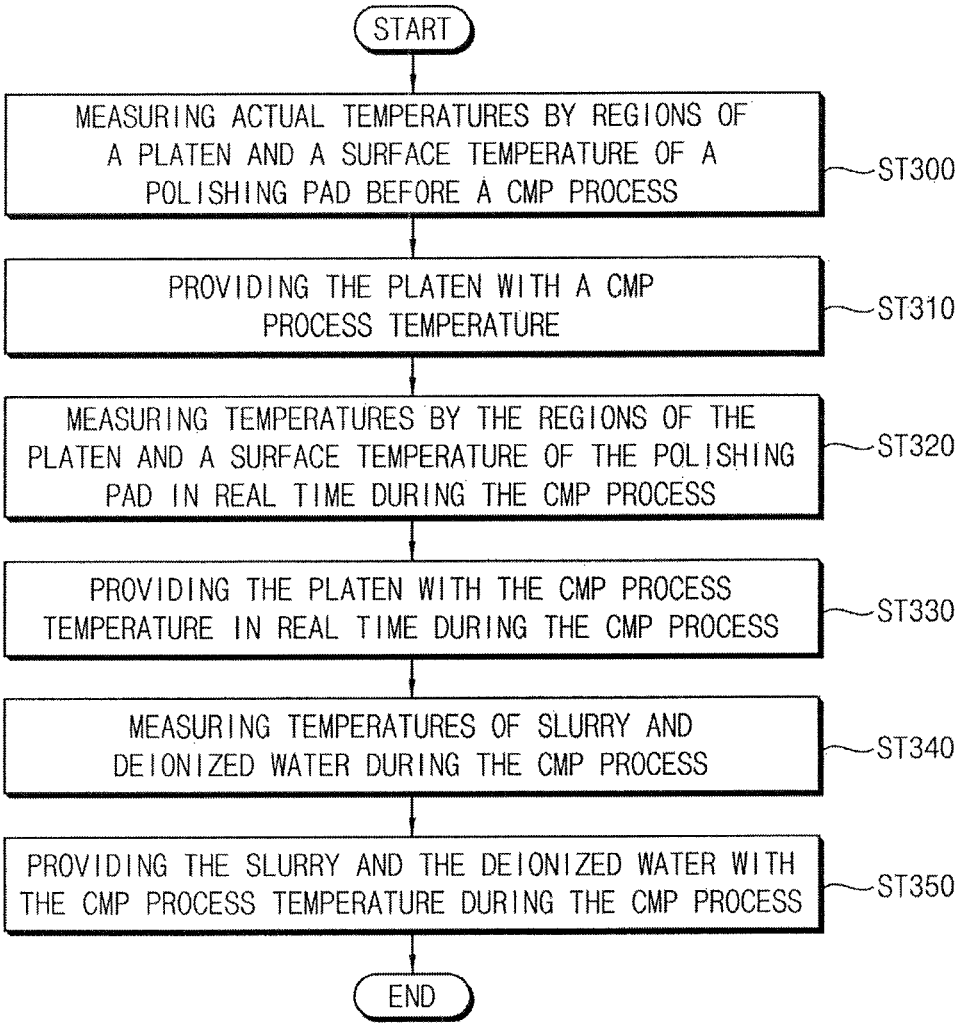
FIG. 6 illustrates a flow chart of a method of controlling a temperature of the CMP apparatus in FIG. 2.

FIG. 6 illustrates a flow chart of a method of controlling a temperature of the CMP apparatus in FIG. 2.

Referring to FIGS. 2 and 6, in step ST300, the first temperature sensors 222, 224, 226, and 228 may measure the actual temperature of the platen 120 before the CMP process. For example, one first temperature sensor 222 may measure the actual temperature of the first region R1 of the platen 120 before the CMP process. Another first temperature sensor 224 may measure the actual temperature of the second region R2 of the platen 120 before the CMP process. Another first temperature sensor 226 may measure the actual temperature of the third region R3 of the platen 120 before the CMP process. Another first temperature sensor 228 may measure the actual temperature of the fourth region R4 of the platen 120 before the CMP process. The measured actual temperatures of the first to fourth regions R1, R2, R3, and R4 may be transmitted to the first to fourth temperature controls 212, 214, 216, and 218 of the first temperature controller 210, respectively.

Further, before the CMP process, the second temperature sensor 230 may measure the surface temperature of the polishing pad 130. The measured temperature of the polishing pad 130 may be transmitted to the first temperature controller 210.

In step ST310, the first temperature controller 210 may provide the platen 120 with the CMP process temperature in accordance with the actual temperatures of the regions of the platen 120 and the surface temperature of the polishing pad 130 measured before the CMP process. For example, if the actual temperature of the first region R1 measured by the one first temperature sensor 222 were to be lower than the CMP process temperature, the first temperature control 212 may heat the first region R1 to provide the first region R1 with the CMP process temperature before the CMP process. Further, if the surface temperature of the polishing pad 130 measured by the second temperature sensor 230 before the CMP process were to be coincided with the CMP process, although the actual temperature of the first region R1 measured by the one first temperature sensor 222 before the CMP process may be lower than the CMP process temperature, the first temperature control 212 may not be operated because the CMP process may be performed on the surface of the polishing pad 130.

After the platen 120 is adjusted to have the CMP process temperature, the substrate S and the polishing pad 130 may be rotated in the opposite directions with supplying of the slurry and the deionized water to perform the CMP process.

In step ST320, during the CMP process, the first temperature sensors 222, 224, 226, and 228 may measure the actual temperatures of the regions R1, R2, R3, and R4 of the platen 120 in real time. The measured actual temperatures of the regions R1, R2, R3, and R4 of the platen 120 may be transmitted to the first temperature controller 210.

Further, during the CMP process, the second temperature sensor 230 may measure the surface temperature of the polishing pad 130 in real time. Because the second temperature sensor 230 may be attached to the polishing head 110, the second temperature sensor 230 may measure the surface temperature of the polishing pad 130 as it performs the CMP process in real time. The measured surface temperature of the polishing pad 130 may be transmitted to the first temperature controller 210.

In step ST330, the first temperature controller 210 may selectively provide the regions R1, R2, R3, and R4 of the platen 120 with the CMP process temperature in accordance with the actual measured temperatures of the regions R1, R2, R3, and R4 of the platen 120 and the surface temperature of the polishing pad 130 measured during the CMP process. For example, if the actual temperature of the first region R1 measured by the of first temperature sensor 222 were to be lower than the CMP process temperature, the first temperature control 212 may heat the first region R1 to provide the first region R1 with the CMP process temperature during the CMP process. Further, if the surface temperature of the polishing pad 130 measured by the second temperature sensor 230 during the CMP process were to be coincided with the CMP process, although the actual temperature of the first region R1 measured by the first temperature sensor 222 during the CMP process may be lower than the CMP process temperature, the first temperature control 212 may not be operated because the CMP process may be performed on the surface of the polishing pad 130.

In step ST340, the third temperature sensor 240 may measure the temperature of the deionized water in real time during the CMP process. The measured temperature of the deionized water may be transmitted to the second temperature controller 260.

Further, the fourth temperature sensor 250 may measure the temperature of the slurry in real time during the CMP process. The measured temperature of the slurry may be transmitted to the third temperature controller 270.

In step ST350, the second temperature controller 260 may heat or cool the deionized water in accordance with the transmitted temperature of the deionized water to provide the deionized water with the CMP process temperature in real time.

The third temperature controller 270 may heat or cool the slurry in accordance with the transmitted temperature of the slurry to provide the slurry with the CMP process temperature in real time.

Measuring the temperatures of the regions R1, R2, R3, and R4 of the platen 120 using the first temperature sensors 222, 224, 226, and 228, measuring the surface temperature of the polishing pad 130 using the second temperature sensor 230, measuring the temperature of the deionized water using the third temperature sensor 240, and measuring the temperature of the slurry using the fourth temperature sensor 250 may be continuously performed during the CMP process.

Further, controlling the temperature of the platen 120 using the first temperature controller 210, controlling the temperature of the deionized water using the second temperature controller 260, and controlling the temperature of the slurry using the third temperature controller 270 may also be continuously performed during the CMP process.

Figure 7:
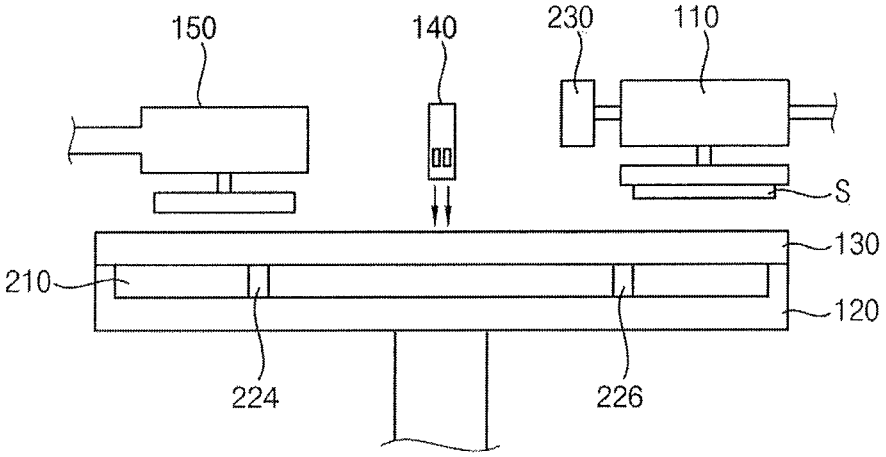
FIG. 7 illustrates a perspective view of a CMP apparatus in accordance with example embodiments.

FIG. 7 illustrates a perspective view of a CMP apparatus in accordance with example embodiments.

A CMP apparatus of this example embodiment may include elements substantially the same as those of the CMP apparatus in FIG. 2 except for further including a conditioner. Thus, the same reference numerals may refer to the same elements and any further illustrations with respect to the same elements may be omitted herein for brevity.

Referring to FIG. 7, a conditioner 150 may be arranged over or facing the platen 120. The conditioner 150 may be configured to remove particles on the polishing pad 130 and restore surface roughness of the polishing pad 130. The conditioner 150 may include a diamond disk.

In an implementation, a conditioning process using the conditioner 150 may be performed after the CMP process. In an implementation, the conditioning process may be performed in-situ with the CMP process. For example, as a portion of the polishing pad 130 polishes the substrate S in the CMP process, the conditioner 150 may perform the conditioning process on another portion of the polishing pad 130.

The first to fourth temperature controls 212, 214, 216, and 218 of the first temperature controller 210 may control the actual temperatures of the regions R1, R2, R3, and R4 of the platen 120 during the conditioning process. Further, the first temperature controller 210 may provide the regions R1, R2, R3, and R4 of the platen 120 with a set conditioning process temperature before the conditioning process.

The first temperature control 212 may receive the actual temperature of the first region R1 measured by the first temperature sensor 222. If the measured actual temperature of the first region R1 were to vary from the set conditioning process temperature, the first temperature control 212 may heat or cool the first region R1 to provide the first region R1 with a temperature corresponding to the conditioning process temperature. Further, the first temperature control 212 may provide the first region R1 with the conditioning process temperature before the conditioning process.

The second temperature control 214 may receive the actual temperature of the second region R2 measured by the first temperature sensor 224. If the measured actual temperature of the second region R2 were to vary from the set conditioning process temperature, the second temperature control 214 may heat or cool the second region R2 to provide the second region R2 with a temperature corresponding to the conditioning process temperature. Further, the second temperature control 214 may provide the second region R2 with the conditioning process temperature before the conditioning process.

The third temperature control 216 may receive the actual temperature of the third region R3 measured by the first temperature sensor 226. If the measured actual temperature of the third region R3 were to vary from the set conditioning process temperature, the third temperature control 216 may heat or cool the third region R3 to provide the third region R3 with a temperature corresponding to the conditioning process temperature. Further, the third temperature control 216 may provide the third region R3 with the conditioning process temperature before the conditioning process.

The fourth temperature control 218 may receive the actual temperature of the fourth region R4 measured by the first temperature sensor 228. If the measured actual temperature of the fourth region R4 were to vary from the set conditioning process temperature, the fourth temperature control 218 may heat or cool the fourth region R4 to provide the fourth region R4 with a temperature corresponding to the conditioning process temperature. Further, the fourth temperature control 218 may provide the fourth region R4 with the conditioning process temperature before the conditioning process.

The second temperature sensor 230 may be configured to measure a surface temperature of the polishing pad 130 in real time during the conditioning process. The surface temperature of the polishing pad 130 measured by the second temperature sensor 230 may be transmitted to the first temperature controller 210.

The second temperature sensor 230 attached to the polishing head 110 may measure the surface temperature of the polishing pad 130 as it performs the conditioning process. For example, as a portion of the polishing pad 130 corresponding to the first region R1 of the platen 120 polishes the substrate S, the second temperature sensor 230 may measure a surface temperature of the portion of the polishing pad 130. The surface temperature of the portion of the polishing pad 130 may be transmitted to the first temperature control 212 of the first temperature controller 210. The first temperature control 212 may heat or cool the first region R1 of the platen 120 in accordance with the surface temperature of the portion of the polishing pad 130 to provide the first region R1 with the conditioning process temperature in real time.

The third temperature sensor 240 may be configured to measure a temperature of the deionized water in real time during the conditioning process. The second temperature controller 260 may heat or cool the deionized water in accordance with the received temperature of the deionized water to provide the deionized water with the conditioning process temperature.

Therefore, the conditioning process may be performed at the conditioning process temperature so that the particles may be effectively removed from the polishing pad 130 and the surface roughness of the polishing pad 130 may be rapidly restored. As a result, the conditioning process may have improved efficiency.

Figure 8:
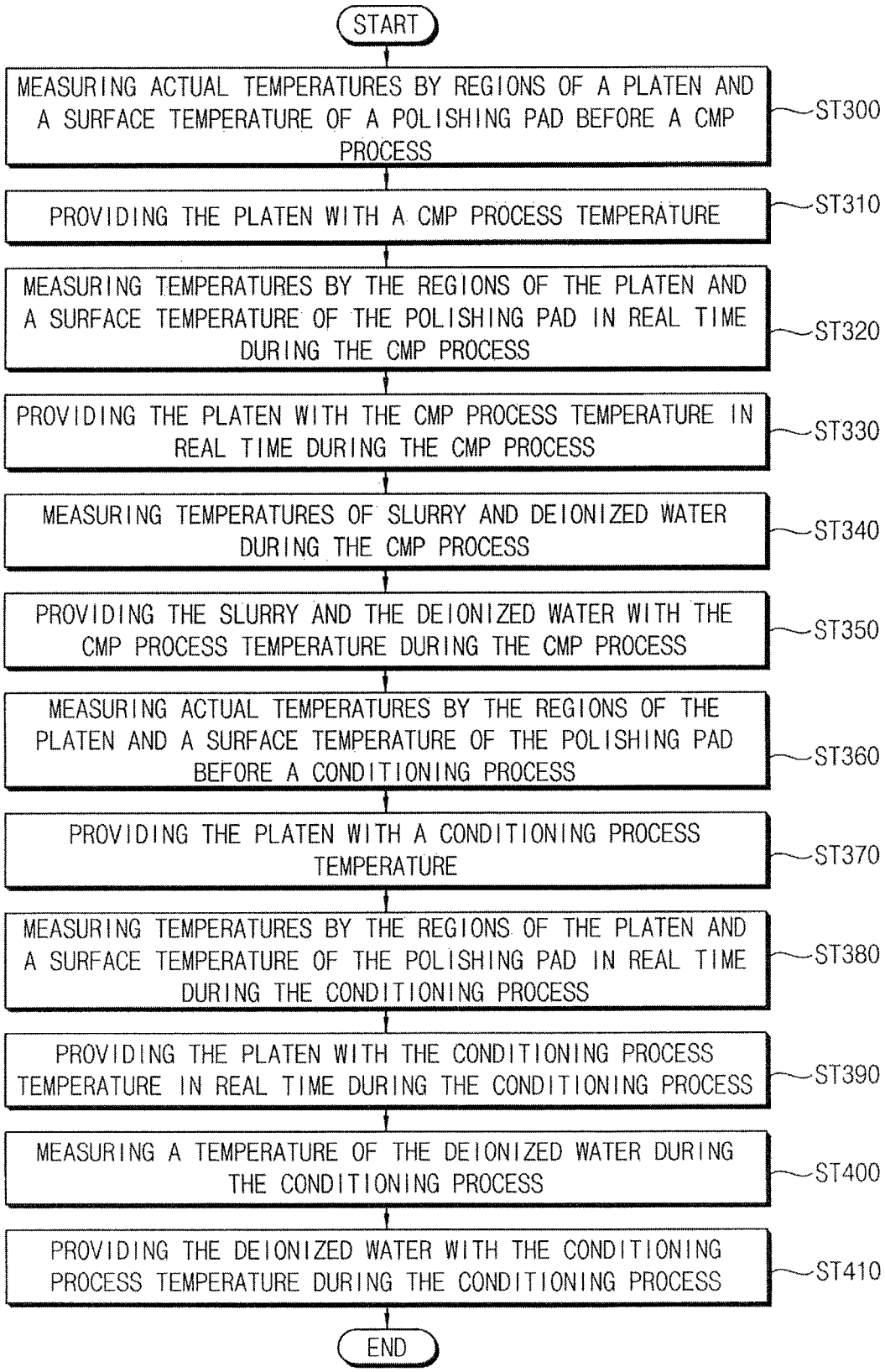
FIG. 8 illustrates a flow chart of a method of controlling a temperature of the CMP apparatus in FIG. 7.

FIG. 8 illustrates a flow chart of a method of controlling a temperature of the CMP apparatus in FIG. 7.

Referring to FIGS. 7 and 8, in step ST300, the first temperature sensors 222, 224, 226, and 228 may measure the actual temperature of the platen 120 before the CMP process. For example, one first temperature sensor 222 may measure the actual temperature of the first region R1 of the platen 120 before the CMP process. Another first temperature sensor 224 may measure the actual temperature of the second region R2 of the platen 120 before the CMP process. Another first temperature sensor 226 may measure the actual temperature of the third region R3 of the platen 120 before the CMP process. Another first temperature sensor 228 may measure the actual temperature of the fourth region R4 of the platen 120 before the CMP process. The measured temperatures by the first to fourth regions R1, R2, R3, and R4 may be transmitted to the first to fourth temperature controls 212, 214, 216, and 218 of the first temperature controller 210, respectively.

Further, before the CMP process, the second temperature sensor 230 may measure the surface temperature of the polishing pad 130. The measured temperature of the polishing pad 130 may be transmitted to the first temperature controller 210.

In step ST310, the first temperature controller 210 may provide the platen 120 with the CMP process temperature in accordance with the actual temperatures of the regions of the platen 120 and the surface temperature of the polishing pad 130 measured before the CMP process.

After the platen 120 is adjusted to have the CMP process temperature, the substrate S and the polishing pad 130 may be rotated in the opposite directions with supplying of the slurry and the deionized water to perform the CMP process.

In step ST320, during the CMP process, the first temperature sensors 222, 224, 226, and 228 may measure the actual temperatures of the regions R1, R2, R3, and R4 of the platen 120 in real time. The measured temperatures of the regions R1, R2, R3, and R4 of the platen 120 may be transmitted to the first temperature controller 210.

Further, during the CMP process, the second temperature sensor 230 may measure the surface temperature of the polishing pad 130 in real time. Because the second temperature sensor 230 may be attached to the polishing head 110, the second temperature sensor 230 may measure the surface temperature of the polishing pad 130 as it performs the CMP process in real time. The measured surface temperature of the polishing pad 130 may be transmitted to the first temperature controller 210.

In step ST330, the first temperature controller 210 may selectively provide the regions R1, R2, R3, and R4 of the platen 120 with the CMP process temperature in accordance with the actual temperatures of the regions R1, R2, R3, and R4 of the platen 120 and the surface temperature of the polishing pad 130 measured during the CMP process.

In step ST340, the third temperature sensor 240 may measure the temperature of the deionized water in real time during the CMP process. The measured temperature of the deionized water may be transmitted to the second temperature controller 260.

Further, the fourth temperature sensor 250 may measure the temperature of the slurry in real time during the CMP process. The measured temperature of the slurry may be transmitted to the third temperature controller 270.

In step ST350, the second temperature controller 260 may heat or cool the deionized water in accordance with the transmitted temperature of the deionized water to provide the deionized water with the CMP process temperature in real time.

The third temperature controller 270 may heat or cool the slurry in accordance with the transmitted temperature of the slurry to provide the slurry with the CMP process temperature in real time.

In step ST360, between the CMP process and the conditioning process, the first temperature sensors 222, 224, 226, and 228 may measure the actual temperature of the platen 120 before the CMP process. The measured actual temperatures of the first to fourth regions R1, R2, R3, and R4 may be transmitted to the first to fourth temperature controls 212, 214, 216, and 218 of the first temperature controller 210, respectively.

Further, before the conditioning process, the second temperature sensor 230 may measure the surface temperature of the polishing pad 130. The measured temperature of the polishing pad 130 may be transmitted to the first temperature controller 210.

In step ST370, the first temperature controller 210 may provide the platen 120 with the conditioning process temperature in accordance with the actual temperatures of the regions of the platen 120 and the surface temperature of the polishing pad 130 measured before the conditioning process.

After the platen 120 is adjusted to have the desired conditioning process temperature, the conditioner 150 may perform the conditioning process on the polishing pad 130 with supplying of the deionized water to perform the conditioning process.

In step ST380, during the conditioning process, the first temperature sensors 222, 224, 226, and 228 may measure the actual temperatures of the regions R1, R2, R3, and R4 of the platen 120 in real time. The measured actual temperatures of the regions R1, R2, R3 and R4 of the platen 120 may be transmitted to the first temperature controller 210.

Further, during the conditioning process, the second temperature sensor 230 may measure the surface temperature of the polishing pad 130 in real time. The measured surface temperature of the polishing pad 130 may be transmitted to the first temperature controller 210.

In step ST390, the first temperature controller 210 may selectively provide the regions R1, R2, R3, and R4 of the platen 120 with the conditioning process temperature in accordance with the temperatures of the regions R1, R2, R3, and R4 of the platen 120 and the surface temperature of the polishing pad 130 measured during the conditioning process.

In step ST400, the third temperature sensor 240 may measure the temperature of the deionized water in real time during the conditioning process. The measured temperature of the deionized water may be transmitted to the second temperature controller 260.

In step ST410, the second temperature controller 260 may heat or cool the deionized water in accordance with the transmitted temperature of the deionized water to provide the deionized water with the conditioning process temperature in real time.

Measuring the temperatures of the regions R1, R2, R3, and R4 of the platen 120 suing the first temperature sensors 222, 224, 226, and 228, measuring the surface temperature of the polishing pad 130 using the second temperature sensor 230, and measuring the temperature of the deionized water using the third temperature sensor 240 may be continuously performed during the conditioning process.

Further, controlling the temperature of the platen 120 using the first temperature controller 210, and controlling the temperature of the deionized water using the second temperature controller 260 may also be continuously performed during the conditioning process.

By way of summation and review, a principal factor for determining a polishing rate of the CMP apparatus may include temperatures of the polishing pad, the platen, the slurry and the deionized water.

In some processes, in order to control the polishing rate of the CMP apparatus, the whole temperature of the platen may be controlled, rather than individually controlling temperatures by regions of the platen. Thus, the temperatures by the regions of the platen may be different from each other, and polishing rates by regions of the semiconductor substrate may also be different from each other. Further, polishing rates with respect to a plurality of the semiconductor substrates may also be different from each other. For example, a difference between latent heats by regions of the polishing pad may be generated, and the polishing pad may be locally deformed. The local deformation of the polishing pad could cause different polishing rates by the regions of the semiconductor substrate.

According to example embodiments, the actual temperatures by the regions of the platen may be measured in real time. The actual temperatures by the regions of the platen may be individually controlled in real time during the CMP process to provide the regions of the platen with predetermined set CMP process temperatures by the regions based on the measured actual temperatures. Thus, the set CMP process temperatures may be promptly provided to the regions of the platen during the CMP process so that polishing rates by regions of the substrate may become uniform. Particularly, a polishing rate with respect to an edge portion of the substrate may be improved.

Further, the above-mentioned temperature control may be performed on the conditioning process so that the conditioning process may have improved efficiency.

The embodiments may provide a method of controlling a CMP process for planarizing a layer on a semiconductor substrate.

The embodiments may provide a method of controlling a chemical mechanical polishing (CMP) process that may be capable of uniformly polishing a substrate.

According to example embodiments, the actual temperatures by the regions of the platen may be measured in real time. The actual temperatures by the regions of the platen may be individually controlled in real time during the CMP process to provide the regions of the platen with predetermined set CMP process temperatures by the regions based on the measured actual temperatures. Thus, the set CMP process temperatures may be promptly provided to the regions of the platen during the CMP process so that polishing rates by regions of the substrate may become uniform. For example, a polishing rate with respect to an edge portion of the substrate may be improved.

As is traditional in the field, embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, and the like, which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions. Also, each block, unit and/or module of the embodiments may be physically separated into two or more interacting and discrete blocks, units and/or modules without departing from the scope herein. Further, the blocks, units and/or modules of the embodiments may be physically combined into more complex blocks, units and/or modules without departing from the scope herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A method of controlling a chemical mechanical polishing (CMP) process, the method comprising:

measuring actual temperatures of at least two regions in a platen in real time during the CMP process in which a polishing pad attached to the platen polishes a substrate held by a polishing head using slurry and deionized water;

receiving the measured actual temperatures of the regions;

individually controlling the actual temperatures of the regions in real time during the CMP process to provide the regions with a predetermined set CMP process temperature;

measuring an initial temperature of the platen before the CMP process;

receiving the measured initial temperature of the platen; and providing the platen with the CMP process temperature.

2. The method as claimed in claim 1, further comprising:
measuring a surface temperature of the polishing pad in real time during the CMP process; and
receiving the surface temperature of the polishing pad.

3. The method as claimed in claim 1, further comprising:
measuring temperatures of the slurry and the deionized water in real time during the CMP process; and
controlling the temperatures of the slurry and the deionized water in real time during the CMP process to provide the slurry and the deionized water with the CMP process temperature.

4. The method as claimed in claim 1, further comprising:
measuring actual temperatures of at least two regions of the platen in real time during a conditioning process on the polishing pad performed after the CMP process;
receiving the measured actual temperatures of the regions; and
individually controlling the actual temperatures of the regions during the conditioning process to provide the regions with a predetermined set conditioning process temperature.

5. The method as claimed in claim 4, further comprising:
measuring a surface temperature of the polishing pad in real time during the conditioning process; and
receiving the surface temperature of the polishing pad.

6. The method as claimed in claim 4, further comprising:
measuring the temperature of the deionized water in real time during the conditioning process; and
controlling the temperature of the deionized water in real time during the conditioning process to provide the deionized water with the conditioning process temperature.

7. The method as claimed in claim 4, further comprising:
measuring the temperature of the platen before the conditioning process;
receiving the measured temperature of the platen; and
providing the platen with the conditioning process temperature.

8. A temperature control for a CMP process, the temperature control comprising:
a plurality of first temperature sensors configured to:
measure actual temperatures of at least two regions in a platen in real time during the CMP process in which a polishing pad attached to the platen polishes a substrate held by a polishing head using slurry and deionized water, and
measure an initial temperature of the platen before the CMP process; and
a first temperature controller configured to:
receive the measured actual temperatures of the regions,
individually control the actual temperatures of the regions in real time during the CMP process to provide the regions with a predetermined set CMP process temperature, and
receive the measured initial temperature of the platen and to provide the platen with the CMP process temperature.

9. The temperature control as claimed in claim 8, further comprising a second temperature sensor configured to measure a surface temperature of the polishing pad in real time during the CMP process,
wherein the first temperature controller is configured to receive the surface temperature of the polishing pad measured by the second temperature sensor.

10. The temperature control as claimed in claim 8, further comprising:
a third temperature sensor configured to measure the temperature of the deionized water in real time during the CMP process;
a second temperature controller configured to control the temperature of the deionized water measured by the third temperature sensor in real time during the CMP process to provide the deionized water with the CMP process temperature;
a fourth temperature sensor configured to measure the temperature of the slurry in real time during the CMP process; and
a third temperature controller configured to control the temperature of the slurry measured by the fourth temperature sensor in real time during the CMP process to provide the slurry with the CMP process temperature.

11. The temperature control as claimed in claim 10, wherein the second and third temperature controllers include a Peltier element.

12. The temperature control as claimed in claim 8, wherein:
the plurality of first temperature sensors are also configured to measure actual temperatures of at least two regions of the platen in real time during a conditioning process on the polishing pad performed after the CMP process, and
the first temperature controller is also configured to receive the measured actual temperatures of the regions and to individually control the actual temperatures of the regions during the conditioning process to provide the regions with a predetermined set conditioning process temperature.

13. The temperature control as claimed in claim 12, further comprising a second temperature sensor configured to measure a surface temperature of the polishing pad in real time during the conditioning process,
wherein the first temperature controller is configured to receive the surface temperature of the polishing pad measured by the second temperature sensor.

14. The temperature control as claimed in claim 12, wherein:
the plurality of first temperature sensors are also configured to measure the temperature of the platen before the conditioning process, and
the first temperature controller is also configured to receive the measured temperature of the platen and to provide the platen with the conditioning process temperature.

15. The temperature control as claimed in claim 8, wherein the first temperature controller includes a Peltier element.

16. A CMP apparatus, comprising:
a polishing head configured to hold a substrate;
a platen arranged under the polishing head;
a polishing pad for polishing the substrate attached to the platen;
a nozzle configured to supply slurry and deionized water to a space between the substrate and the polishing pad;
a plurality of first temperature sensors configured to:
measure actual temperatures of at least two regions in the platen in real time during a CMP process, and
measure an initial temperature of the platen before the CMP process; and
a first temperature controller configured to:
receive the measured actual temperatures of the regions, individually control the actual temperatures of the regions in real time during the CMP process to provide the regions with a predetermined set CMP process temperature, and receive the measured initial temperature of the platen and provide the platen with the CMP process temperature.

17. The CMP apparatus as claimed in claim 16, further comprising:

a second temperature sensor attached to the polishing head, the second temperature sensor being configured to measure a surface temperature of the polishing pad in real time during the CMP process;

a third temperature sensor configured to measure the temperature of the deionized water in real time during the CMP process;

a second temperature controller configured to control the temperature of the deionized water measured by the third temperature sensor in real time during the CMP process to provide the deionized water with the CMP process temperature;

a fourth temperature sensor configured to measure the temperature of the slurry in real time during the CMP process; and a third temperature controller configured to control the temperature of the slurry measured by the fourth temperature sensor in real time during the CMP process to provide the slurry with the CMP process temperature.

18. The CMP apparatus as claimed in claim 16, further comprising a conditioner configured to perform a conditioning process on the polishing pad.

* * * * *